US012264442B2

(12) United States Patent
Shelstad

(10) Patent No.: US 12,264,442 B2
(45) Date of Patent: Apr. 1, 2025

(54) LEVELLING SYSTEM FOR A ROAD CONSTRUCTION MACHINE

(71) Applicant: MOBA Mobile Automation AG, Limburg (DE)

(72) Inventor: David Shelstad, Peachtree City, GA (US)

(73) Assignee: MOBA Mobile Automation AG, Limburg (DE)

( * ) Notice: Subject to any disclaimer, the term of this patent is extended or adjusted under 35 U.S.C. 154(b) by 299 days.

(21) Appl. No.: 17/683,953

(22) Filed: Mar. 1, 2022

(65) Prior Publication Data

US 2022/0220676 A1 Jul. 14, 2022

Related U.S. Application Data

(63) Continuation of application No. PCT/EP2020/075731, filed on Sep. 15, 2020.

(30) Foreign Application Priority Data

Sep. 20, 2019 (EP) ..... 19198712

(51) Int. Cl.
*E01C 19/48* (2006.01)
*E01C 23/088* (2006.01)
*E01C 23/12* (2006.01)

(52) U.S. Cl.
CPC ..... *E01C 19/4873* (2013.01); *E01C 23/088* (2013.01); *E01C 23/127* (2013.01)

(58) Field of Classification Search
CPC .. E01C 19/4873; E01C 23/088; E01C 23/127; E01C 19/48; E01C 19/004
See application file for complete search history.

(56) References Cited

U.S. PATENT DOCUMENTS 5,393,167 A 2/1995 Fujita et al.
6,027,282 A 2/2000 Horn
9,869,063 B1 1/2018 Brenner et al.
(Continued)

FOREIGN PATENT DOCUMENTS

CN 115075096 A 9/2022
DE 29619831 U1 1/1997
(Continued)

*Primary Examiner* — Daniel M. Robert
(74) *Attorney, Agent, or Firm* — PERKINS COIE LLP; Michael A. Glenn

(57) ABSTRACT

A levelling system for a road construction machine, especially for a paving machine or a road milling machine, includes a first height sensor arrangement, a second height sensor arrangement, a first controller, a second controller and an additional sensor. The first controller includes a first controller loop configured to control a height position of the first side of the tool or of the first side of the machine chassis based on the first actual value and a first setpoint. The second controller includes a second controller loop configured to control a height position of the second side of the tool or of the second side of the machine chassis based on the second actual value and a second setpoint. The first and/or the second controller are configured to adapt the setpoint based on the actual reference value, wherein a setpoint adaption takes place only either on the first side or on the second side of the tool or of the machine.

17 Claims, 8 Drawing Sheets

(56) References Cited

U.S. PATENT DOCUMENTS

| | | | | |
|---|---|---|---|---|
| 2008/0152428 | A1 | 6/2008 | Berning et al. | |
| 2011/0299926 | A1 | 12/2011 | Berning et al. | |
| 2015/0054331 | A1* | 2/2015 | Berning | E01C 23/088 299/1.5 |
| 2017/0233958 | A1* | 8/2017 | Utterodt | E01C 19/4833 701/50 |
| 2018/0340302 | A1 | 11/2018 | Menzenbach et al. | |
| 2022/0290382 | A1 | 9/2022 | Simon et al. | |

FOREIGN PATENT DOCUMENTS

| | | | |
|---|---|---|---|
| DE | 19951297 | C1 | 4/2001 |
| DE | 19951296 | C2 | 6/2001 |
| EP | 0542297 | A1 | 5/1993 |
| EP | 0547378 | A1 | 6/1993 |
| EP | 2392731 | A2 | 12/2011 |
| EP | 3406799 | A1 | 11/2018 |

* cited by examiner

LEVELLING SYSTEM FOR A ROAD CONSTRUCTION MACHINE

CROSS-REFERENCES TO RELATED APPLICATIONS

This application is a continuation of copending International Application No. PCT/EP2020/075731, filed Sep. 15, 2020, which is incorporated herein by reference in its entirety, and additionally claims priority from European Application No. EP 19 198 712.2, filed Sep. 20, 2019, which is incorporated herein by reference in its entirety.

Embodiments of the present invention refer to a levelling system and a road construction machine. Further embodiments refer to a method for levelling and to a computer program. In general, the present invention relates to the technical field of mobile road construction machines, in particular to a levelling system for road finishing machines, (road paver, asphalt paver) or milling machines.

BACKGROUND OF THE INVENTION

A road paver on a tracked or wheeled drive runs on a prepared foundation (road bed) onto which a street surface to be produced or road pavement to be produced is to be applied. As a rule the road pavement is a bituminous material, wherein however layers with sand or stone or concrete layers may also be added in. Provided behind the road paver, in the direction of travel, is a height-adjustable screed, and piled on its front side is a supply of the road paving material that is supplied and distributed by a conveyor device that makes sure that the amount of road paving material kept on the front side of the screed is adequate but is not too much. The height of the rear edge of the screed relative to the surface of the prepared foundation, which may also be formed by an old road pavement covering, establishes the thickness of the street surface produced prior to its subsequent further consolidation by rollers. The screed is held on a tow arm that is borne rotatably movable about a tow point arranged in the center area of the road paver, the height of the screed being determined by a hydraulic adjusting device. The height of the screed is controlled by at least one levelling system. Mobile milling machines, which are also referred to as so-called cold milling machines, comprise a rotatably mounted milling drum that is fixed with respect to its axis of rotation relative to the chassis of the milling machine. The milling machine has a front and a rear landing gear. Depending on the milling machine or milling machine type, one of the two landing gears (front or rear) can be manually adjusted to a fixed value in height. The corresponding other landing gear has a chassis height adjustment, which is controlled in response to a milling (cutting) depth control signal.

A known road paver (road finisher) is described for instance in EP 0 542 297 A1. The road finisher has, instead of a mechanical sensing runner for producing a level-control signal for a vertically adjustable plate, an ultrasonic control device with at least two, advantageously three, ultrasonic sensors which are arranged in the direction of movement of the road finisher at a considerable distance on the plate. By means of the ultrasonic sensor signals, the distances of each ultrasonic sensor from a reference surface are detected, those values which lie outside the plane by more than a predetermined distance, which plane is determined by the measurement points assigned to the remaining distances, being rejected as incorrect measurements. The evaluation device calculates the projected level at the rear edge of the plate with reference to the level signals, the mutual spacings between the sensors and the distance of a sensor from the rear edge of the plate.

Furthermore, EP 0 547 378 A1 describes an apparatus for controlling the cutting depth of a road grooving machine by vertical adjustment of both the front and rear travelling gear on the basis of a cutting depth control signal, which is generated by a tracer ski by sampling a reference plane, including at least three ultrasonic sensors arranged one behind the other in the direction of movement of the cutter, and an evaluation means for determining the distances between the ultrasonic sensors and a reference plane to derive therefrom an inclination signal as well as an averaged distance signal. The evaluation means controls the height of the two travelling gears such that the average distance of the cutter drum as well as the position of the machine relative to the reference plane are adjusted.

The U.S. Pat. No. 6,027,282 A describes a control device for controlling the application of a material which is adapted to be applied to a subgrade by means of a road finisher, said road finisher comprising a tractor and a floating screed, which is attached by means of at least one draw arm to the tractor in such a way that said screed is arranged behind said tractor in the direction in which the road finisher is moving when in operation, a first end of said at least one draw arm being secured to the tractor by means of a vertically adjustable coupling device, and a second end of said at least one draw arm being rigidly secured to the floating screed, said control device comprising a device for detecting the height of a screed edge in relation to a reference height, said screed edge being the rear lower edge of the screed in the direction of movement. The control device further comprises a device for detecting the inclination of said at least one draw arm in relation to a reference plane. A device for controlling the height of the vertically adjustable coupling device controls the height of said vertically adjustable coupling device on the basis of the detected inclination and the detected height of the rear lower edge of the screed.

While controlling a height of a screed, e.g. in order to adapt the thickness of the pavement to be applied, unevenness of the underground is often problematic. Therefore, there is the need for an improved approach.

SUMMARY

An embodiment may have a road construction machine, especially a paving machine or a milling machine, having a levelling system, the road construction machine including a chassis and a tool, the levelling system having: a first height sensor arrangement coupled to a first side of the tool or to a first side of the chassis of the machine and configured to determine a first distance information as first actual value for a distance to an underground or to an applied layer in reference to a reference point belonging to the first side of the tool or to the first side of the chassis; and a second height sensor arrangement coupled to the second side of the tool or to a second side of the chassis and configured to determine a second distance information serving as second actual value for a distance to the underground or to the applied layer in reference to the reference point belonging to the second side of the tool or to the second side of the chassis; and a first controller including a first independent controller loop configured to control a height position of the first side of the tool or of the machine chassis based on the first actual value and a first setpoint for the height position of the first side of the tool or of the chassis; and a second controller including a second independent controller loop independent from the first independent controller loop and configured to control a height position of the second side of the tool or of the chassis based on the second actual value and a second setpoint for the height position of the second side of the tool or of the chassis; and an additional sensor coupled to the tool or the chassis and configured to determine an actual reference value for either the first or the second side of the tool or either the first or the second side of the chassis, the actual reference value describing a height position of either the first or the second side of the tool or either the first or the second side of the chassis; wherein the first and the second controllers are configured to adapt the setpoint based on the actual reference value of the additional sensor, wherein a setpoint adaption performed by the first or the second controller takes place only either on the first side or the second side of the tool or of the chassis.

Another embodiment may have a method for performing a levelling for road construction machines, especially for a paving machine or a milling machine, the road construction machine including a chassis and a tool, the method having the steps of: determining a first distance information as first actual value for a distance to an underground or to an applied layer in reference to a reference point belonging to the first side of the tool or to a first side of the chassis using a first height sensor arrangement coupled to a first side of the tool or to the first side of the chassis; determining a second information serving as second actual value for a distance to the underground or to the applied layer in reference to the reference point belonging to the second side of the tool or to a second side of the chassis using a second height sensor arrangement coupled to the tool or to the second side of the chassis; controlling, using a first independent controller loop, a height position of the first side of the tool or of the first side of the chassis based on the first actual value and a first setpoint for the height position of the first side of the tool or of the first side of the chassis and controlling, using a second independent controller loop independent from the first independent controller loop, a height position of the second side of the tool or of the second side of the chassis based on the second actual value and a second setpoint for the height position of the second side of the tool or of the second side of the chassis; determining an actual reference value using an additional sensor coupled to the tool or to the chassis, the actual reference value describing a height position of the tool or of the chassis; and adapting either the first or the second setpoint based on said actual reference value.

Another embodiment may have a non-transitory digital storage medium having a computer program stored thereon to perform the method for performing a levelling for road construction machines, especially for a paving machine or a milling machine, the road construction machine including a chassis and a tool, the method having the steps of: determining a first distance information as first actual value for a distance to an underground or to an applied layer in reference to a reference point belonging to the first side of the tool or to a first side of the chassis using a first height sensor arrangement coupled to a first side of the tool or to the first side of the chassis; determining a second information serving as second actual value for a distance to the underground or to the applied layer in reference to the reference point belonging to the second side of the tool or to a second side of the chassis using a second height sensor arrangement coupled to the tool or to the second side of the chassis; controlling, using a first independent controller loop, a height position of the first side of the tool or of the first side of the chassis based on the first actual value and a first setpoint for the height position of the first side of the tool or of the first side of the chassis and controlling, using a second independent controller loop independent from the first independent controller loop, a height position of the second side of the tool or of the second side of the chassis based on the second actual value and a second setpoint for the height position of the second side of the tool or of the second side of the chassis; determining an actual reference value using an additional sensor coupled to the tool or to the chassis, the actual reference value describing a height position of the tool or of the chassis; and adapting either the first or the second setpoint based on said actual reference value, when said computer program is run by a computer.

Embodiments of the present invention provide a levelling system for a road construction machine, e.g. a paving machine or a road milling machine. The road construction machine comprises a chassis (machine body or machine frame) and a tool (e.g. screed or milling drum). The levelling system comprises a first height sensor arrangement, a second height sensor arrangement, a first controller, a second controller and an additional sensor. The first height sensor arrangement (e.g. a single sensor, like ultrasonic sensor or a support mechanism comprising a plurality of sensors) is coupled to a first side of the tool or to a first side of the chassis of the machine (e.g. the left side or the right side of the tool or of the machine) and configured to determine a first distance information, (e.g. a height value of the screed with respect to the underground) as first actual value (for a distance to an underground or to an applied layer) in reference to a reference point belonging to the first side of the tool or to the first side of the machine. The second height sensor arrangement, e.g. another ultrasonic sensor or another support mechanism comprising a plurality of sensors, is coupled to a second side of the tool or a second side of the chassis of the machine (the corresponding other side of the tool or of the machine, e.g. the left side or the right side of the tool or of the machine) and configured to determine a second distance information serving as second actual value (for a distance to the underground or to the applied layer) in reference to the reference point belonging to the second side of the tool or to the second side of the machine. The first controller comprises a first control loop configured to control a height position of the first side of the tool or of the machine chassis based on the first actual value and a first setpoint for the height position of the first side of the tool or of the machine chassis. The second controller comprises a second control loop configured to control a height position of the second side of the tool or of the machine chassis based on the second actual value and a second setpoint for the height position of the second side of the tool or of the machine chassis. The additional sensor (e.g. a cross slope sensor or a layer thickness measurement sensor system or a (laser based) 3D control system) is coupled to the tool or the machine chassis and configured to determine an actual reference value for either one side of the tool or either one side of the machine chassis (either the first side or the second side of the tool or of the machine), the actual reference value also describing a height position of either one side of the tool or either one side of the machine chassis (either the first side or the second side of the tool or of the machine). The first and/or the second controller or both controllers are further configured to adapt the setpoint based on the actual reference value of the additional sensor, whereby a setpoint adaption (adjustment) takes place only either on the first side or on the second side of the tool or of the machine.

The first side of the tool or of the (chassis of) the machine can be either the left side or the right side of the tool or of the machine (seen in the direction of travel of the machine).

Correspondingly, the second side of the tool or of the (chassis of) the machine may be either the left side or the right side of the tool or of the machine (seen in the direction of travel of the machine).

Embodiments of the present invention are based on the finding that an additional sensor device (either cross-slope sensor, layer thickness measurement system or 3D control system or similar) can be used to form additional closed loop control of the set point of one of the control loops of the levelling system controlling the first or the second machine site. The additional sensor device would input into the control loop of one of the levelling systems with its own set point (slope, layer thickness, . . . ) whose output is an adjustment of the grade set point in the levelling system control loop. It is effectively a control loop within a control loop. This has the advantage that the smoothness performance of the slope control can be improved, while maintaining the proper thickness without compromising on smoothness.

According to embodiments, the road construction machine may be a paving machine, so the tool may be a screed. According to further embodiments, the road construction machine may be a road milling machine, so the tool may be a milling unit/milling drum, whereby the milling unit/milling drum is usually (rigidly, fixed) connected/coupled to the chassis (machine body or machine frame) of the road milling machine. For both implementations, the tool extends in parallel to the underground or the applied layer (22) and/or substantially perpendicular (e. g. 75° to 105°) to a driving direction of the road construction machine.

According to embodiments, the additional sensor comprises a cross slope sensor coupled to the tool or to the chassis of the machine and configured to determine an inclination of the tool or of the machine chassis transverse to the direction of travel of the road construction machine, wherein the actual reference value is derived from an actual inclination value. Here the first and/or the second controller may adapt its setpoint (first and/or second setpoint) such that the tool or the machine chassis has a predetermined inclination.

According to further embodiments, the additional sensor comprises a layer thickness measuring system configured to determine a thickness of the applied layer (when the road construction machine is a paving machine), wherein the actual reference value is derived from an actual layer thickness value. Alternatively, the additional sensor comprises a layer thickness measuring system (milling depth measuring system) configured to determine a thickness/depth of the milled underground (when the road construction machine is a milling machine), wherein the actual reference value is derived from an actual layer thickness value. Here, the first and/or the second controller may adapt its setpoint (first and/or second setpoint) such that a minimum and/or maximum thickness of the applied layer is maintained.

According to further embodiments, the additional sensor comprises 3D position determiner configured to determine a height position of the tool or of the chassis of the machine, wherein the actual reference value is derived from a height position value. Here, the first and/or the second controller may adapt its setpoint (first and/or second setpoint) such that minimum and/or maximum height position of the tool or of the machine chassis is maintained.

According to embodiments, the first height sensor arrangement comprises a plurality of first height sensors, which may be arranged (coupled to the first side of the tool or to the first side of the chassis of the machine) along the driving direction. This has the purpose that small unevenness can be compensated due to averaging. The plurality of first height sensors may be attached by a support mechanism, e.g. attached to the screed or to the tow arm (when the road construction machine is a paving machine) or to the chassis of the road construction machine (e.g. when the road construction machine is a milling machine). According to further embodiments, one or more first height sensors are arranged behind the screed or the milling drum (when seen within the driving direction), so that this first height sensor can measure a distance to the pavement. The height sensors arranged before the screed or the milling drum typically measure a distance to the underground. As already indicated, according to embodiments, the first height sensor arrangement/first height sensor is attached to the screed or to the tow arm (when the road construction machine is a paving machine) or to the chassis of the road construction machine (e.g. when the road construction machine is a milling machine).

Note, the second height sensor arrangement may also be implemented analogously to the first height sensor arrangement. According to embodiments, the second height sensor arrangement comprises a plurality of second height sensors, which may be arranged (coupled to the second side of the tool or to the second side of the chassis of the machine) along the driving direction. The plurality of second height sensors may be attached by a support mechanism, e.g. attached to the screed or to the tow arm (when the road construction machine is a paving machine) or to the chassis (machine body or machine frame) of the road construction machine (e.g. when the road construction machine is a milling machine). According to further embodiments, one or more second height sensors are arranged behind the screed or the milling drum (when seen within the driving direction), so that this second height sensor can measure a distance to the pavement. The height sensors arranged before the screed or the milling drum typically measure a distance to the underground. According to embodiments, the second height sensor arrangement/second height sensor is attached to the screed or to the tow arm (when the road construction machine is a paving machine) or to the chassis of the road construction machine (e.g. when the road construction machine is a milling machine).

The first height sensor arrangement can be either arranged on the left or on the right side of the machine (seen in the direction of travel of the machine). Correspondingly, the second height sensor arrangement may be either arranged on the left or the right side of the machine (seen in the direction of travel of the machine).

Another embodiment provides a road construction machine, especially a paving machine or a milling machine comprising the levelling system as described above.

Another embodiment provides a corresponding method for levelling. The method comprises the steps:

- determining a first distance information as first actual value for a distance to an underground or to an applied layer in reference to a reference point belonging to the first side of the tool or to the first side of the chassis of the machine (machine body or machine frame) using a first height sensor arrangement coupled to a first side of the tool or to the first side of the chassis of the machine;
- determining a second information serving as second actual value for a distance to the underground or to the applied layer in reference to the reference point belonging to the second side of the tool or to the second side of the chassis of the machine (machine body or machine frame) using a second sensor coupled to the tool or to the second side of the chassis of the machine;

controlling, using a first controller loop, a height position of the first side of the tool or of the first side of the machine chassis based on the first actual value and a first setpoint for the height position of the first side of the tool or of the first side of the machine chassis and controlling, using a second controller loop, a height position of the second side of the tool or of the second side of the machine chassis based on the second actual value and a second setpoint for the height position of the second side of the tool or of the second side of the machine chassis;

determining an actual reference value for either the first or the second side of the tool or of the machine chassis, the actual reference value describing a height position of either the first or the second side of the tool or of the machine chassis using another sensor coupled to the tool or to the machine chassis; and adapting either the first or the second setpoint based on the actual reference value.

This method may be performed by use of a computer program.

According to an embodiment, the method may be performed by use of a computer program.

Also for the method and the computer program as described above, the first side of the tool or of the (chassis of) the machine can be either the left side or the right side of the tool or of the machine (seen in the direction of travel of the machine). Correspondingly, the second side of the tool or of the (chassis of) the machine may be either the left side or the right side of the tool or of the machine (seen in the direction of travel of the machine).

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
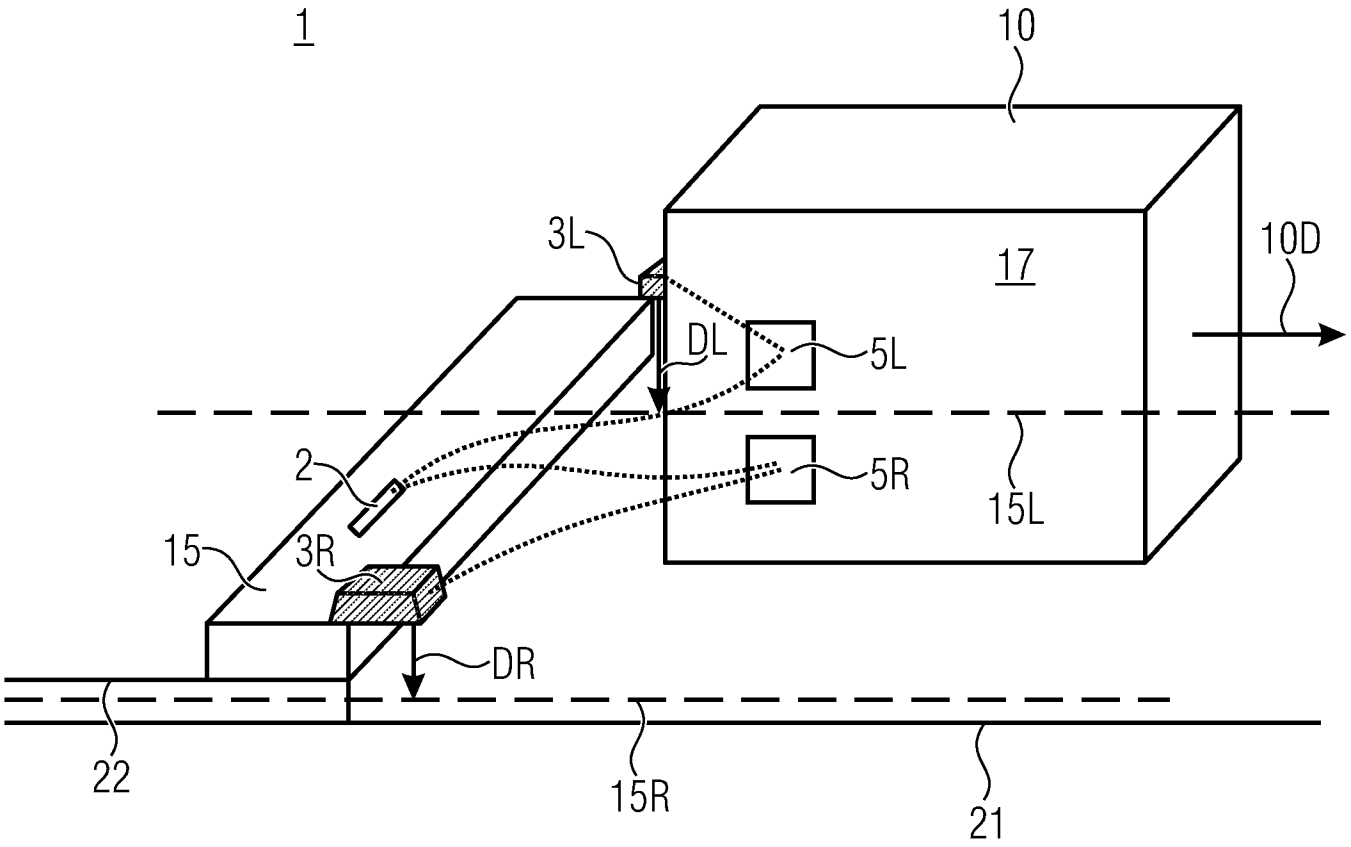
FIG. 1*a* shows a schematic block diagram of a measurement system according to a basic embodiment.

Below, embodiments of the present invention will subsequently be discussed referring to the enclosed figures, wherein identical reference numerals are provided to objects having an identical or similar function, so that the description thereof is mutually applicable and interchangeable.

FIG. 1*a* shows a road construction machine 10 comprising at least a screed 15 as tool and a measurement system 1 to be used as input for the levelling system. The measurement system 1 comprises at least the following entities, namely a distance sensor 3R, a distance sensor 3L, an additional sensor 2, here a cross slope sensor 2, a right controller 5R and a left controller 5L. The road construction machine 10 may be a paving machine driving along the direction 10D.

The distance sensor 3R (arranged at the right side of the screed 15) as well as the distance sensor 3L (arranged at the left side of the screed 15) may be ultrasonic sensors measuring a distance/height from a reference point or reference height to the underground 21 or to the newly applied pavement 22. The sensor 3R is marked by the R, since the sensor is arranged at one side, here the right side of the screed 15. The sensor 3L is consequently arranged on the other/left side. The sensors 3R/3L determines/monitors the respective distances DL/DR, e.g. to the underground, along one length position of the screed 15. This length position for the sensor 3R is marked by 15R. The position 15R may be selected along the width of the screed 15, such that an even surface along the (entire) line 15R can be scanned. For example, but not necessarily, the position 15R is at the right end of the screed 15.

Both distance sensors 3L/3R have the purpose to determine actual distance values DL/DR (here, actual height values). By use of the actual height/distance values the actual height positions of the two sides of the screed 15 can be monitored and height positions can be controlled. In detail, typically, both actual distance values DR/DL are compared to respective set points for the respective side, so that the tool 15 at the respective side can be adjusted with regard to its height in order to track the set point for the respective side. Expressed in other words, this means that two levelling systems of the controllers 5L/5R are used to control the height of the screed 15 and also have the inclination of the screed transverse to direction of travel 10D of the road finishing machine 10. This means that each machine side 10L/R is controlled (levelled) separately, i.e. there are two independent levelling systems that have two independent control loops for the left and the right side of the machine 10.

When two measurement/levelling systems are used at a road finishing machine 10, i.e. each machine side 10L/R is controlled (levelled) separately, it may happen that on one side 10R of the machine (for instance on the right machine side 10R) the evenness of the new pavement road surface 22 is good, whereas on the opposite machine side 10L (left machine side), the evenness of the new road surface 22 is bad due to greater unevenness in the underground 21 to be paved.

To handle this problem, the idea is to control the set point of the control loop of the levelling system controlling the one machine side having the uneven underground 21. As discussed above, the typical control loop (first and second controller 5L/5R) is based on a set point and a sensor feedback with the output of the levelling controller controlling the position of the tow point cylinder to keep the actual position at the set point. When now the set point is adapted based on the additional sensor device 2, the additional sensor device 2 would input the control loop (second controller 5L) of the levelling system 1 controlling the left machine side 10L with its own set point (slope, layer thickness, . . . ) whose output is an adjustment of the grade set point in the levelling system control loop. Due to adapting the set point of the side having the uneven underground, it can be counter-railed that the uneven underground 21 is transferred to the new pavement 22, since the set point is adjusted when the tool/screed 15 deviates from the desired path. By use of an inclination sensor 2 as additional sensor the deviation can be detected, when the inclination exceeds the desired position. Expressed from this point of view, this means that another measurement principle is used for validating the real control value, here the distance value measured by using the sensor 3L. For the same principle other sensors than the cross-slope sensors 2 can be used, for example the layer thickness measurement system (not shown) can be used as well. Here, the layer thickness value forms the basis for adapting the set point of the control loop for the left machine side 10L. According to another embodiment, an external height sensor, e.g. implemented using a so-called total station (prism/tachymeter) may be used as sensor 2. For example, a height value for the screed, which is measured by the total station, may be used for adapting the set point of the control loop for the left machine side 10L.

In this context, it is understood that it is also possible, that on the other side 10L of the machine (left machine side 10L) the evenness of the new pavement road surface 22 is good, whereas on the opposite machine side 10R (right machine side), the evenness of the new road surface 22 is bad (also due to greater unevenness in the underground 21 to be paved). From the above description, it is understood that in this case the additional sensor device 2 would input the control loop (controller 5R) of the levelling system 1 controlling the right machine side 10R with its own set point (slope, layer thickness, . . . ) whose output is an adjustment of the grade set point in the levelling system control loop.

To sum up, the first and the second controller 5L/5R form the two control loops, namely one for the left and one for the right side, wherein, based on the sensor signal from the additional sensor 2, the set point of one of the levelling control loops for the left or the right side will be adapted.

Regarding the sensors 3L and 3R it should be noted that these may be ultrasonic control units, as described in EP 0 542 297 A1 or EP 0 547 378 A1. These sensors typically use three or four ultrasonic sensors because of the fact that the ultrasonic sensors scan the surface at a plurality of widely spaced points, so that elongated bumps in particular are well-balanced.

Dependent on the distance to be measured, the sensor 3R as a single sensor, like ultrasonic sensor, is arranged in front or behind the screed 15. In order to enable that the sensor 3R can measure the height of the screed with reference to the underground 21 or the new pavement 22, the sensor 3R is implemented as height sensor, i.e. measures a distance substantially perpendicular to the underground 21. The position of the height sensor with respect to the screed 15, and especially with respect to the rear edge of the screed 15 is (at least during operation) fixed so that by measuring the distance DR between the screed 15/rear edge of the screed 15 and the underground 21/new pavement 22 can be calculated. This can be done, e.g. by taking into account the offset between the mounting height of the sensor 3R and the respective reference point of the screed 15, e.g. the rear edge.

In order to enable that the position between the sensor 3R and the reference of the screed 15 maintains at least during operation constant the sensor 3R may be directly or indirectly attached to the screed 15. Indirectly means that a support mechanism may be used or that the sensor 3R or the corresponding support mechanism is attached to a tow arm of the screed 15.

Regarding the slope sensor 2 it should be noted that same may be directly attached to the screed or somehow coupled to same, such that a cross slope (along the length of the screed 15 and transverse to the direction of travel 10D of the machine 10) can be measured.

There are a number of different combinations of the set point control loop invention, as described in more detail below.

Figure 2A:
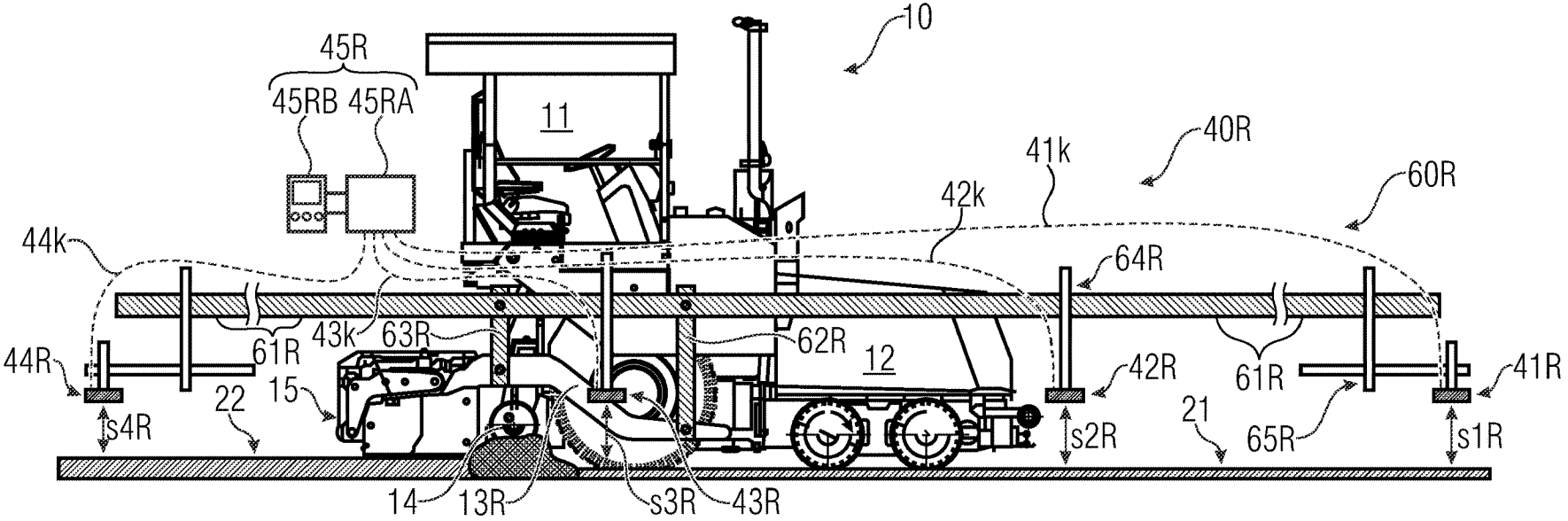
FIG. 2*a*, 2*b* show schematic illustrations of a road paving machine comprising a measurement system/levelling system according to embodiments.

The present invention will be detailed below referring to the appended drawings. FIG. 2*a* shows a road finishing machine 10 illustrated schematically in a side view, comprising a control platform 11, a material bunker 12 and a screed 15, which is movable attached to the machine chassis via two tow arms 13L (left machine side) and 13R (right machine side). During the paving drive, the road finishing machine 10 moves on the underground to be asphalted 21, whereby paving material is transported from the material bunker 12 via a non-depicted conveyor device underneath the control platform 11 through the chassis of the road finishing machine 10 to the rear to the screed 15 by which it is processed into a new pavement layer 22.

As shown in FIG. 2*a*, at the right tow arm 13R of the road paver 10 a support mechanism 60R is arranged for a sensor system (measurement system/levelling system) 40R, wherein this is advantageously arranged at two points at the tow arm 13R. Advantageously, the main support mechanism 61R is releasable secured both in the front region of the tow arm, for example in the immediate vicinity of the tow point, by means of a holder 62R and in the rear region, for example in the immediate vicinity of the attachment of the screed 15, by means of a holder 63R. On the main support mechanism 61, which extends along the direction of travel of the paver 10, further releasable secured and along the main support mechanism 61R slideable holders 64R are arranged, by means of which individual distance sensors 41R to 44R of the sensor system (measurement system/levelling system) 40R are held. For further (fine) adjustment of the outer distance sensors 41R and 44R further releasable secured and displaceable holders 65R are provided. Advantageously, the main support mechanism 61R consists of individual or individually connectable mechanical parts or even by means of a twisting mechanism rotatable items or even telescopic items in order to adjust the system in length individually. For known sensor and levelling systems, variable lengths in the range of 9 to 13 meters are common.

The sensor system 40R shown in FIG. 2*a* consists of four distance sensors 41R to 44R, but it is also conceivable that are only three distance sensors 41R, 43R and 44R arranged, which scan an underground 21 still to be processed and a new pavement layer 22. The sensor system 40R thus comprises at least two distance sensors 41R, 42R and/or 43R in front of the screed 15, which scan the still to be processed underground 21 and determine distance values s1R, s2R and/or s3R to the underground 21 still to be processed, as well as a further distance sensor 44R, which scan the newly laid or new built-in road surface 22 and determines a distance value s4R to the newly laid or newly installed road surface 22. The basic structure of the sensor system 40R shown schematically in FIG. 2 essentially corresponds to the systems known from conventional technology.

The sensor system 40R further comprises a levelling system control unit 45R, consisting essentially of a process control unit 45RA and an operating and monitoring unit (control and display device) 45RB. The individual distance sensors 41R to 44R may be connected via cable connections 41*k* to 44*k* to the process control unit 45RA, which reads in and processes the measured distance values s1R to s4R of the distance sensors 41R to 44R. Furthermore, the process control unit 45RA controls the height position of the screed 15 as a function of the measured distance values s1R to s4R, that means the process control unit 45RA functions as a leveling unit. Via the operating and monitoring unit 45RB, an operator, for example the screed personnel, can set adjustments or changes to various parameters concerning the leveling or monitor them during the installation process. The operating and monitoring unit 45RB serves as a so-called human-machine interface (HMI or MMI). In an advantageous variant, the process control unit 45RA and the operating and monitoring device 45RB are combined in one device or in one housing, that means components are integrated within one device or housing.

Figure 2B:
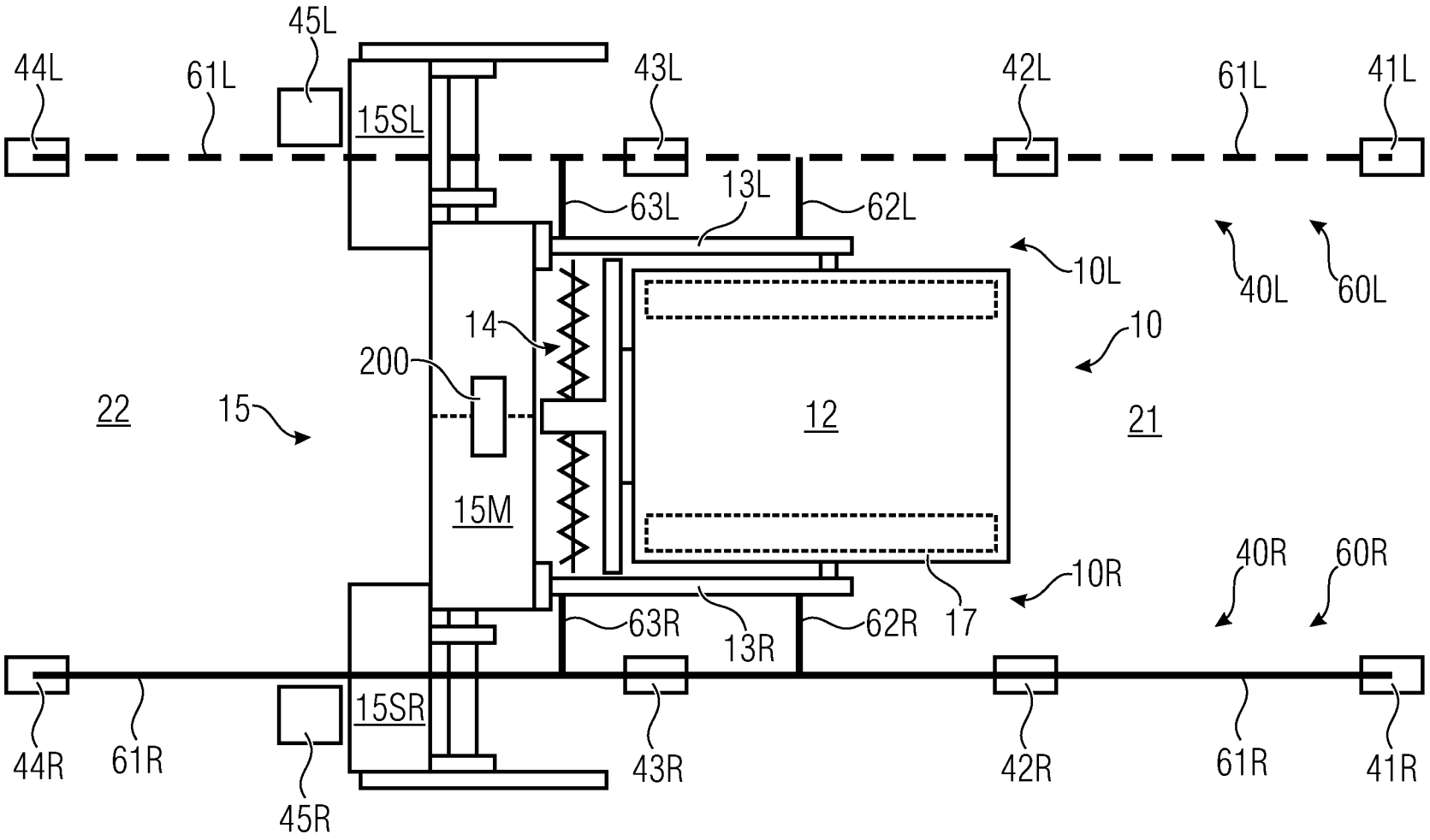
Figure 3:
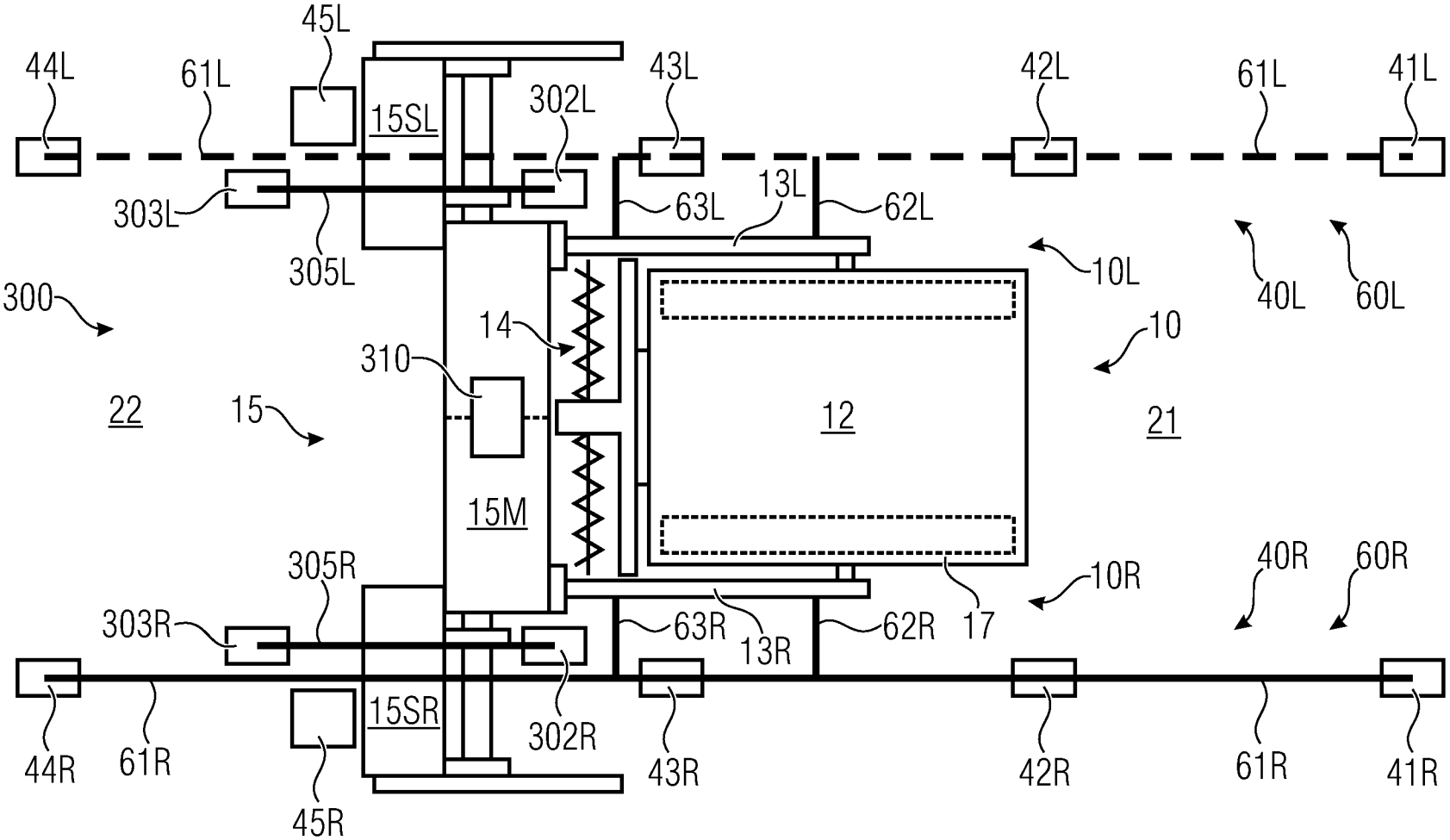
FIG. 3 show schematic views of a road paving machine for illustrating further embodiments.
Figure 4A:
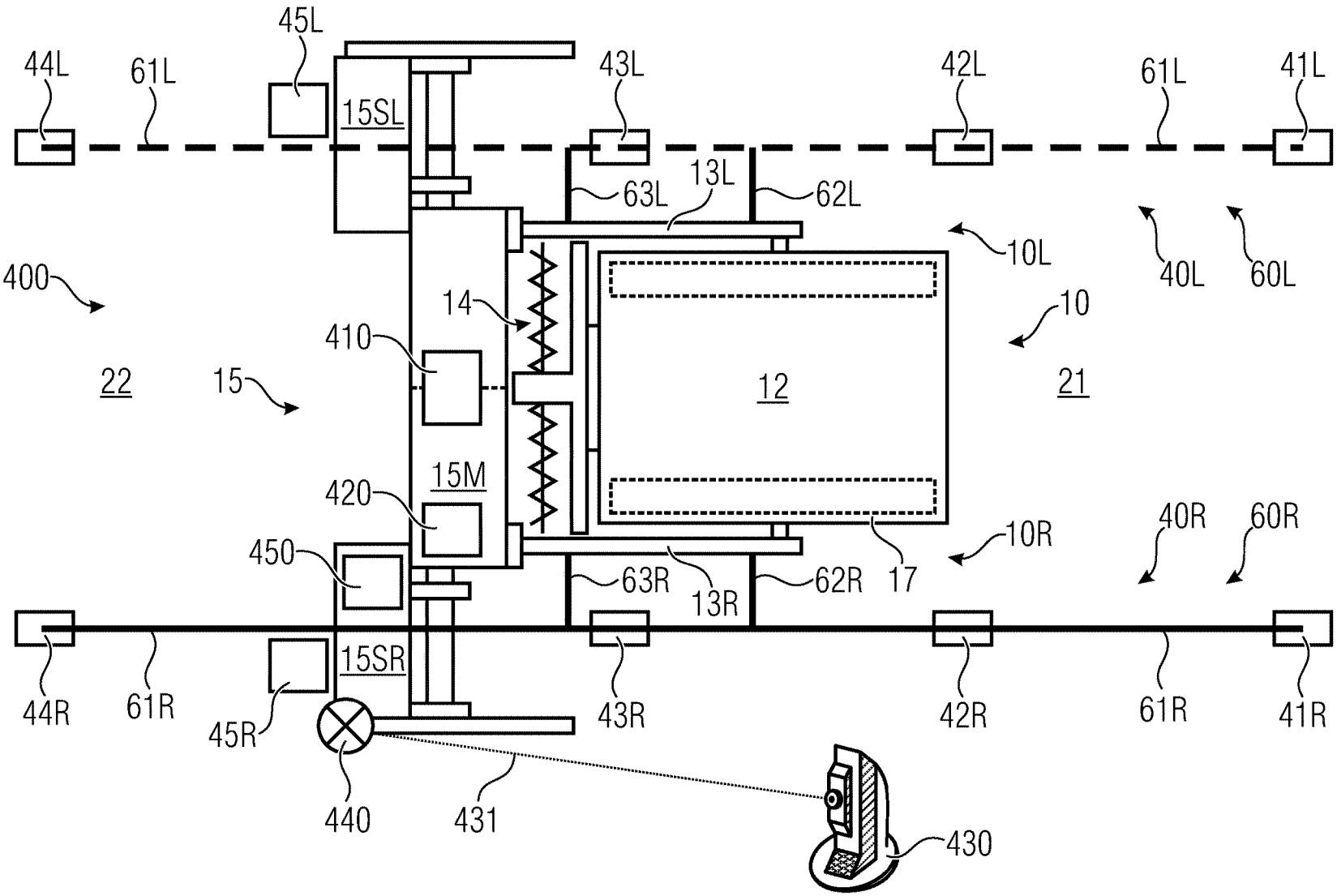
FIGS. 4*a*, 4*b* illustrate the use of the measurement system/levelling system in connection with a 3D control system according to an enhanced embodiment.

FIGS. 2*b*, 3 and 4*a* show the road finishing machine (paver) 10 illustrated schematically in a bird view, comprising two sensor systems (measurement systems/levelling systems) 40L and 40R as described above, whereby each sensor system (measurement system/levelling system) 40L and 40R comprises four distance sensors 41L/R . . . 44L/R. With these two sensor systems (measurement systems/levelling systems) 40L and 40R each machine/tool side (left/right) is controlled (levelled) separately.

As shown in FIGS. 2*b*, 3 and 4*a*, the road finishing machine 10 comprises furthermore an additional sensor device 200, 300 or 400. The additional sensor device 200, 300 or 400 would input into the control loop of one of the sensor systems (measurement systems/levelling systems) 40L or 40R, controlling the left or right machine side 10L/R with its own set point whose output is an adjustment of the grade set point in the levelling system control loop.

As shown in FIG. 2*b*, the additional sensor device is a cross slope sensor 200, which is arranged above the main screed 15M, advantageously on a crossbeam attached to the screed 15. The cross slope sensor 200 measures the inclination of the screed 15 transverse to the direction of travel of the road finishing machine 10. As shown in FIG. 3, the additional sensor device is a layer thickness measuring system 300, which is arranged at screed extensions 15SL and 15SR. It is also possible, that the layer thickness measuring system 300 is arranged at the main screed 15M. The layer thickness measuring system 300 comprises distance sensors 302L/R and 303L/R, whereby the distance sensors 302L and 303L are arranged on the left machine side 10L at a mechanical holder 305L, and the distance sensors 302R and 303R are arranged on the right machine side 10R at a mechanical holder 305R. Distance sensors 302L/R are arranged in front of the screed 15 and measure the distances to the underground to be asphalted 21; distance sensors 303L/R are arranged behind the screed 15 and measure the distances to the newly applied road surface 22. Out of the measurement signals from the distance sensors 302L/R and 303L/R a layer thickness control unit 310 calculates the layer thickness of the newly applied road surface 22 during the paving drive.

Figure 4B:
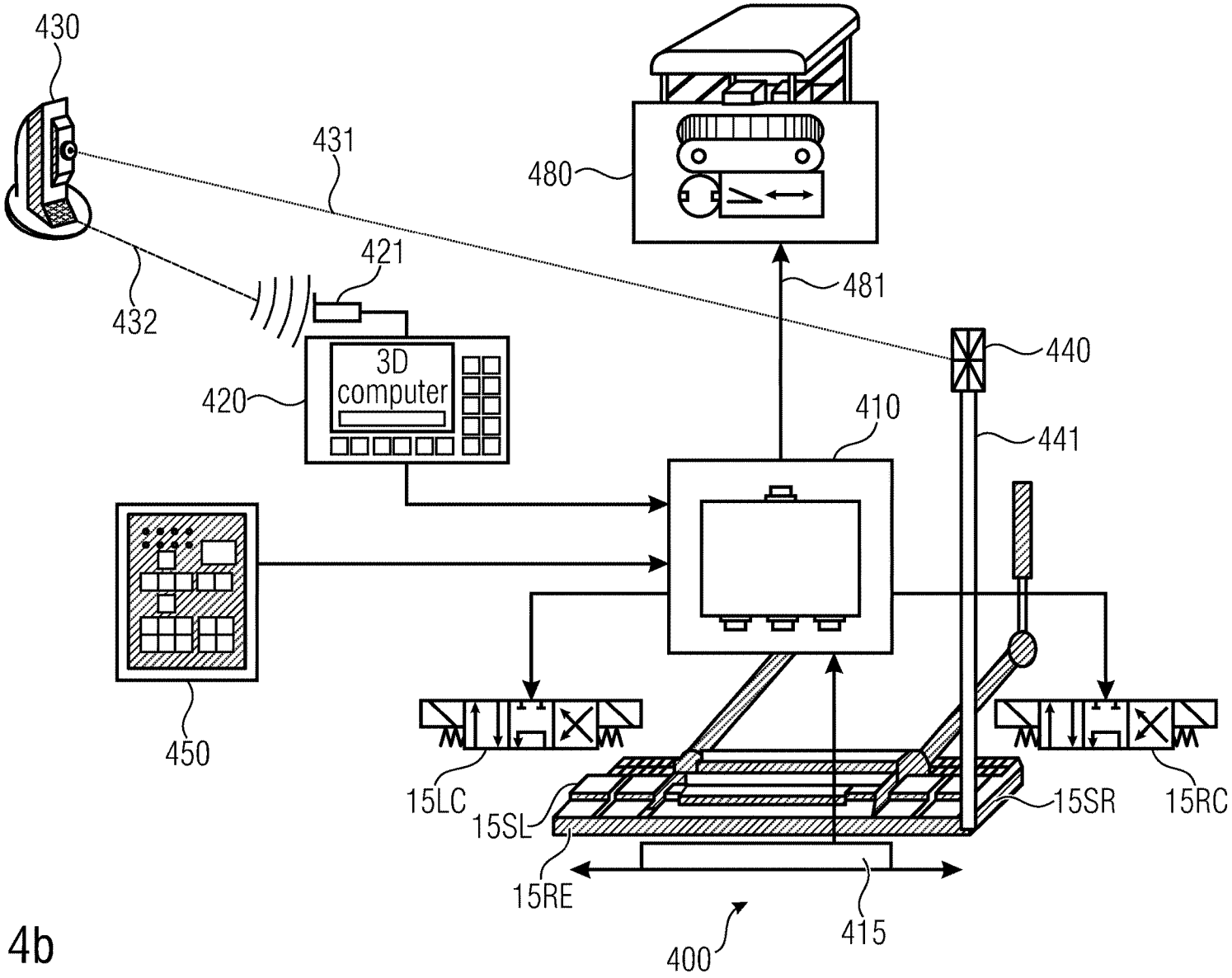

As shown in FIG. 4*a*, the additional sensor device is a 3D control system 400. Such a 3D control system 400 is described for instance in DE 199 51 296 C2 or DE 199 51 297 C1. Briefly described, the 3D control system 400 comprises a tachymeter (total station) 430 to determine the position of a reference point (prism 440), whereby the prism 440 is arranged above the screed 15, advantageously as shown in FIG. 4*a* at the rear edge of the screed extension 15SR. FIG. 4*b* shows the 3D control system 400 in more detail. A 3D operating and monitoring unit 420 receives signals 432 from the tachymeter (total station) 430 via an antenna 421 and sends these signals to a 3D process control unit 410, which calculates the position of a correction point from the position of the reference point (prism 440) and the target stretch.

All described additional sensor devices 200, 300 or 400 may be coupled to the sensor system (measuring system/leveling system) 40L or 40R, so that in the control loop of the sensor system (measuring system/leveling system) 40L or 40R, the set point of the additional sensor devices 200, 300 or 400 is included. Coupling one of the additional sensor devices 200, 300 or 400 to the sensor system (measurement system/levelling system) 40L or 40R is effectively a control loop within a control loop.

The advantages of coupling one of the additional sensor devices 200, 300 or 400 to the sensor system (measurement system/levelling system) 40L or 40R is for instance improving the smoothness performance of the slope control and maintaining the proper thickness without compromising on smoothness.

As already described above, via the operating and monitoring units 45LB and 45RB, the operator, for example the screed personnel, can set adjustments or changes to various parameters concerning the levelling. For instance, the operator can make adjustments manually with regard to the set point of the sensor system (measurement system/levelling system) 40L and/or 40R, whereby the additional sensor device 200, 300 or 400 acts like a supervisory sensor or supervisory system.

Figure 5:
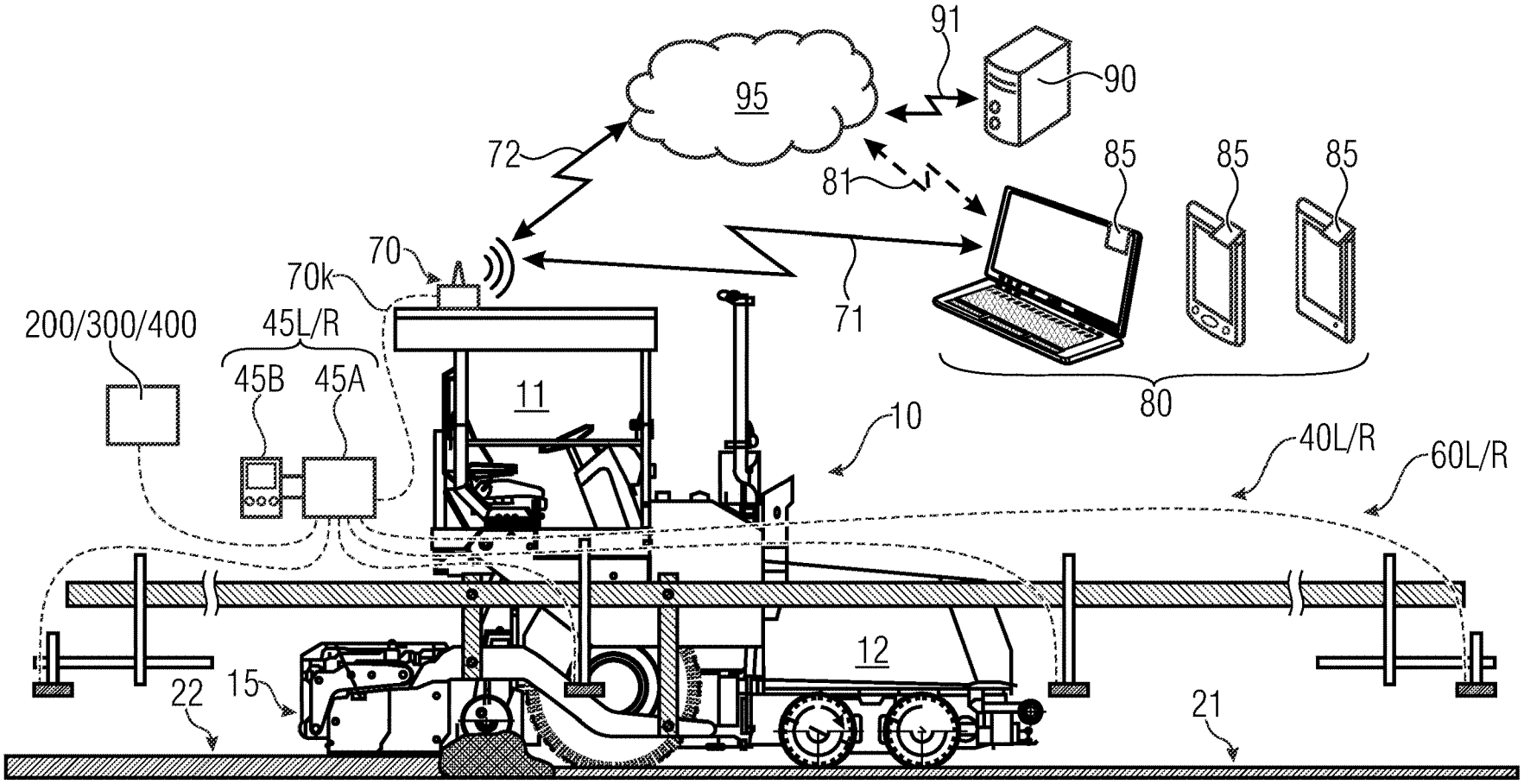
FIG. 5 illustrates optional details for the measurement system/levelling system according to further embodiments.

FIG. 5 shows an additional wireless communication interface unit 70 arranged on the road finishing machine 10, which is connected via a cable connection 70*k* to the process control unit 45A of the levelling system control unit 45L/R. Via the wireless communication interface unit 70, the sensor system (measuring system/leveling system) 40L or 40R is able to wirelessly exchange data with a remote data server system 90 and/or a mobile device 80, that is to say to wirelessly transmitting data to said devices 80 and 90 and receiving data wirelessly from these devices 80 and 90. The mobile device 80 can be, for example, a laptop computer or a tablet PC or a smartphone or the like, wherein the mobile device 80 has a communication unit 85 in order to be able to communicate via corresponding wireless connection types such as WLAN, Bluetooth, etc.

For example, via connection links 71 or 72, data such as measured distance measurements from the distance sensors 41L/R . . . 44L/R and/or data indicative of the height of the screed 15 sent to the mobile device 80 or over a network 95 to the data server 90 for logging calculation or evaluation purposes. As a result, a machine operator or construction site supervisor has an overview of the paving process and can react immediately in the event of problems such as the failure of a distance sensor. Furthermore, via a connection 71, 81 and 91, data may also be sent from the mobile device 80 to the sensor system (measuring system/leveling system) 40L or 40R on the paver 10 or to the data server 90, for example to set calculation parameters of the controller's calculation algorithm or to include data relating to the sensor system (measuring system/leveling system) 40L or 40R stored on the data server 90. It is also conceivable in this context that calculations of the control device during the asphalt installation are not (only) carried out in the process computer unit(s) 45LA/RA of the levelling system control unit 45L/R, but (also) on the data server 90, for which purpose a continuously existing data or communication connection between the process control unit(s) 45LA/RA on the paver 10 and the data server 90 is a requirement. Also for remote maintenance purposes, the communication device 70, the communication links 71, 72, 81 and 91 and the mobile devices 80 are suitable, for example, to remotely retrieve a status of the sensor system (measuring system/leveling system) 40L or 40R and/or to detect and resolve an occurring error of the sensor system (measuring system/leveling system) 40L or 40R.

Although embodiments of the invention have been explained with reference to a road finishing machine, it can also be used on road milling machines (as described above).

Figure 6:
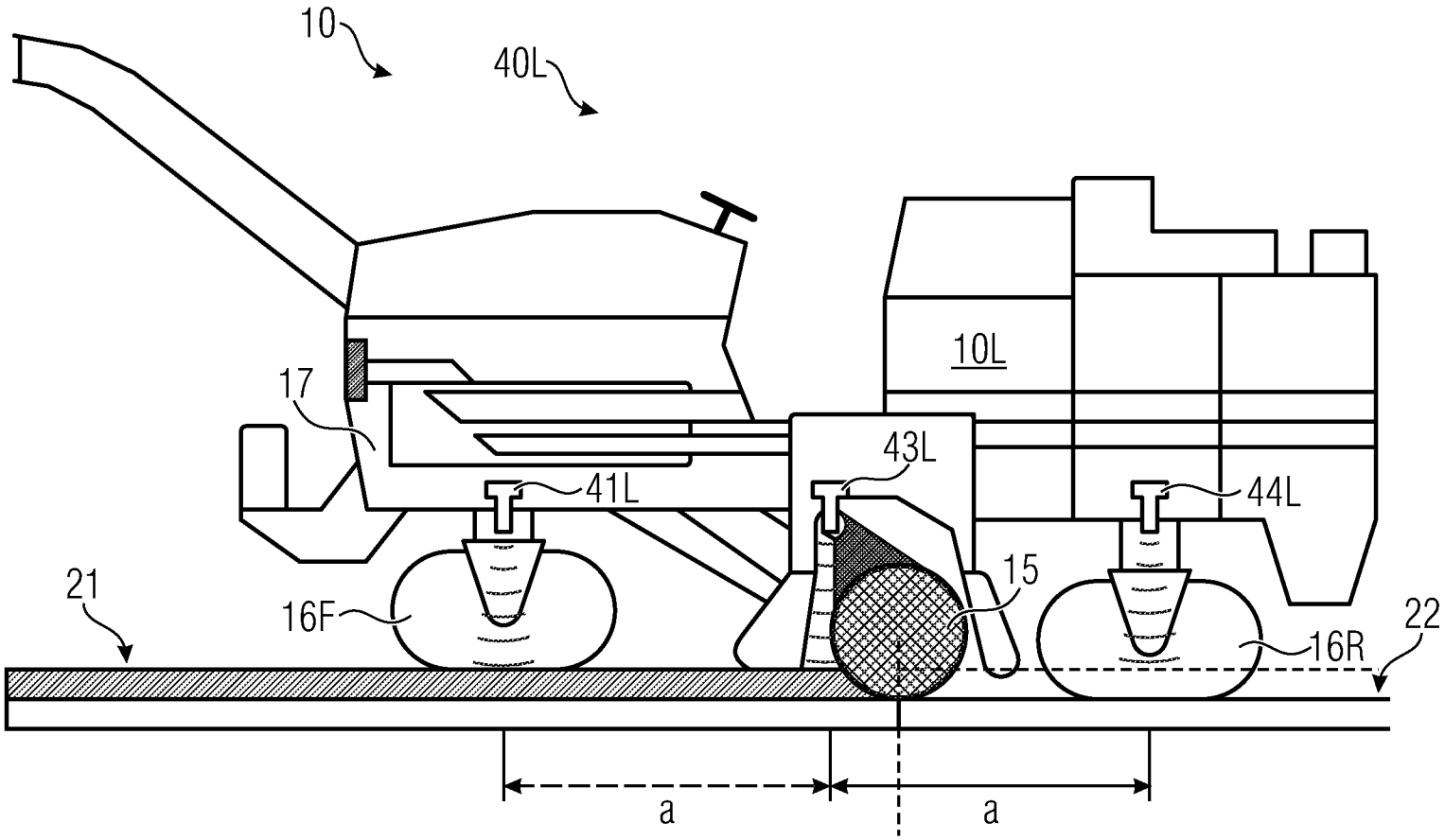
FIG. 6 show a schematic illustration of a road milling machine comprising a measurement system/levelling system according to embodiments.

FIG. 6 shows a road milling machine 10 illustrated schematically in a side view, comprising a milling drum/milling unit 15 as tool, which is rigidly (fixed) connected/coupled to the chassis 17 (machine body or machine frame) of the road milling machine 10. The road milling machine 10 has two front and two rear landing gears 16F and 16R, whereby in FIG. 6 only the left front and the left rear landing gears 16F and 16R are shown. The road milling machine 10 comprises a sensor system 40L, which consists of three distance sensors 41L, 43L and 44R, which are coupled to the chassis 17 (machine body or machine frame) of the machine 10 and which scan an underground 21 still to be milled and a milled road surface 22. The sensor system 40L thus comprises at least two distance sensors 41L and 43L in front of the milling drum/milling unit 15, which are arranged at a distance a from each other and scan the still to be milled underground 21 and determine distance values to the underground 21 still to be milled, as well as a further distance sensor 44L, which is arranged at a distance a from sensor 43L and scan the milled road surface 22 and determines a distance value to the milled road surface 22. The basic structure of the sensor system 40L shown schematically in FIG. 6 essentially corresponds to the system known from conventional technology as described in EP 0 547 378 A1. The sensors 41L, 43L and 44R scan the surface at a plurality of widely spaced points, so that elongated bumps in particular are well-balanced.

The sensor system 40L further comprises a levelling system control unit (not shown in FIG. 6), consisting essentially of a process control unit and an operating and monitoring unit (control and display device). The individual distance sensors 41L, 43L and 44L may be connected via cable connections to the process control unit, which reads in and processes the measured distance values of the distance sensors 41L, 43L and 44L. Furthermore, the process control unit controls the height position of the milling drum/milling unit 15 as a function of the measured distance values, that means the process control unit functions as a leveling unit. Via the operating and monitoring unit, an operator, for example the milling machine personnel, can set adjustments or changes to various parameters concerning the leveling or monitor them during the milling process. The operating and monitoring unit serves as a so-called human-machine interface (HMI or MMI). In an advantageous variant, the process control unit and the operating and monitoring device are combined in one device or in one housing, that means components are integrated within one device or housing.

As already described in relation to the road paving machine above, it is also conceivable that the road milling machine 10 illustrated schematically in FIG. 6 comprises a further (second) sensor system (measurement systems/levelling systems) 40R (not shown in FIG. 6) on the other (right) machine side 10R, which is similar to the sensor system (measurement system/levelling system) 40L as described above. With these two sensor systems (measurement systems/levelling systems) 40L and 40R each machine/tool side (left/right) is controlled (levelled) separately.

The road milling machine 10 illustrated schematically in FIG. 6 comprises furthermore an additional sensor device (not shown in FIG. 6). The additional sensor device would input into the control loop of one of the sensor systems (measurement systems/levelling systems) 40L or 40R, controlling the left or right machine side 10L/R with its own set point whose output is an adjustment of the grade set point in the levelling system control loop.

The additional sensor device is a cross slope sensor, which is arranged at the machine chassis 17. The cross slope sensor measures the inclination of the machine chassis 17 and therefore the inclination of the milling drum/milling unit 15 transverse to the direction of travel of the road milling machine 10.

Furthermore, it is also conceivable that the additional sensor device is a layer thickness measuring system (milling depth measuring system), which measures the layer thickness of the milled road surface during the milling drive. A road milling machine and method for measuring the milling depth is for instance described in US 2008/0152428 A1.

It is also conceivable that the additional sensor device is a 3D control system. Such a 3D control system is described for instance in DE 199 51 296 C2 or DE 199 51 297 C1 by means of a paving machine. The 3D control system comprises a tachymeter (total station) to determine the position of a reference point (prism), whereby the prism may be arranged at the chassis (machine body or machine frame) 17 of the milling machine 10. A 3D operating and monitoring unit receives signals from the tachymeter (total station) via an antenna and sends these signals to a 3D process control unit, which calculates the position of a correction point from the position of the reference point (prism) and the target stretch.

Regarding the milling machine, all described additional sensor devices may be coupled to the sensor system (measuring system/leveling system) 40L or 40R, so that in the control loop of the sensor system (measuring system/leveling system) 40L or 40R, the set point of the additional sensor devices is included (similar to the explanations with regard to the paving machine described above). Coupling one of the additional sensor devices to the sensor system (measurement system/levelling system) 40L or 40R is effectively a control loop within a control loop.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LIST OF REFERENCE NUMERALS

10 Asphalt paver (road finishing machine)/Road milling machine
10L/R Machine side (left/right)
11 Control platform
12 Hopper (material bunker)
13L/R Tow arm (left/right)
14 Auger
15 Screed/Milling drum (milling unit)
15M Main screed
15L/R Length positions (left/right) for sensors
15SL/SR Screed extensions (left/right)
15LC/RC Screed extension control (left/right)
15RE Screed rear edge
16F/R Front and rear landing gear
17 Chassis (machine body or machine frame)
21 Underground to be asphalted/Underground to be milled
22 Newly applied road surface/milled road surface
40L/R Sensor system (measurement system/levelling system) (left/right)
41L/R, 44L/R Distance sensors (left/right)
41*k* . . . 44*k* Cable connection
45L/R Levelling system control unit (left/right)
45LA/RA Process control unit (left/right)
45LB/RB Operating and monitoring unit (left/right)
60L/R Levelling system support mechanism (left/right)
61L/R Main support mechanism (left/right)
62L/R, 63L/R Mechanical holders (left/right)
64L/R, 65L/R Slideable mechanical holders for distance sensors (left/right)
70 Wireless communication interface unit
70*k* Cable connection
80 Mobile device (laptop computer, smartphone or any other kind of mobile or portable device)
85 Communication unit
90 Data server system
71,72,81,91 Communication links
95 Network
200 Cross Slope Sensor
300 Layer Thickness Measuring System
302L/R,303L/R Distance sensors (left/right)
305L/R Mechanical holders for distance sensors (left/right)
310 Layer Thickness control unit
400 3D Control System
410 3D Process control unit
415 Screed width measuring device
420 3D Operating and monitoring unit
421 Antenna
430 Tachymeter (total station)
431 Measuring direction to prism
432 Data signal
440 Prism
441 Mechanical holder for prism
450 Screed width input unit
480 Steering control unit
481 Control signal for steering control unit
DL/DR Actual height values (left/right)/Actual distance values (left/right)
1 Levelling system
2 Additional sensor
3L/3R Distance sensors (left/right)
5L/5R Controller (second/first)/(left/right)
10D direction of travel of the machine
a Distance between two sensors

The invention claimed is:

1. A road construction machine, especially a paving machine or a milling machine, comprising a levelling system, the road construction machine comprising a chassis and a tool, the levelling system comprising:

a first height sensor arrangement coupled to a first side of the tool or to a first side of the chassis of the machine and configured to determine a first distance information as first actual value for a distance to an underground or to an applied layer in reference to a reference point belonging to the first side of the tool or to the first side of the chassis; and a second height sensor arrangement coupled to the second side of the tool or to a second side of the chassis and configured to determine a second distance information serving as second actual value for a distance to the underground or to the applied layer in reference to the reference point belonging to the second side of the tool or to the second side of the chassis; and a first controller comprising a first independent controller loop configured to control a height position of the first side of the tool or of the machine chassis based on the first actual value for said distance to the underground or to the applied layer and a first setpoint set point for the height position of the first side of the tool or of the chassis; and a second controller comprising a second independent controller loop independent from the first independent controller loop and configured to control a height position of the second side of the tool or of the chassis based on the second actual value for said distance to the underground or to the applied layer and a second setpoint set point for the height position of the second side of the tool or of the chassis; and an additional sensor coupled to the tool or the chassis and configured to determine an actual reference value for either the first or the second side of the tool or either the first or the second side of the chassis-, the actual reference value describing a height position of either the first or the second side of the tool or either the first or the second side of the chassis;

wherein the first controller is configured to adapt the respective first set point based on the actual reference value of the additional sensor for a set point adaption and the second controllers are controller is configured to adapt the respective setpoint set point based on the actual reference value of the additional sensor for the set point adaption, wherein the setpoint set point adaption performed by the first or the second controller takes place only either on the first side or the second side of the tool or of the chassis.

2. The road construction machine according to claim 1, wherein the additional sensor comprises a cross slope sensor coupled to the tool or to the chassis of the machine and configured to determine an inclination of the tool or of the chassis transverse to the direction of travel of the road construction machine, wherein the actual reference value is derived from an actual inclination value.

3. The road construction machine according to claim 1, wherein the first and/or the second controller adapts its setpoint set point such that the tool or the chassis comprises a predetermined inclination.

4. The road construction machine according to claim 1, wherein the additional sensor comprises a layer thickness measuring system configured to determine a thickness of the applied layer, wherein the actual reference value is derived from an actual layer thickness value; or wherein the additional sensor comprises a layer thickness measuring system configured to determine a thickness of the milled underground, wherein the actual reference value is derived from an actual layer thickness value.

5. The road construction machine according to claim 1, wherein the first and/or the second controller adapts its setpoint set point such that a minimum and/or maximum thickness of the applied layer is maintained.

6. The road construction machine according to claim 1, wherein the additional sensor comprises 3D position determiner configured to determine a height position of the tool or of the chassis, wherein the actual reference value is derived from a height position value.

7. The road construction machine according to claim 1, wherein the first and/or the second controller adapts its set point such that minimum and/or maximum height position of the tool or of the chassis is maintained.

8. The road construction machine according to claim 1, wherein the first height sensor arrangement comprising a plurality of height sensors coupled to the first side of the tool or to the first side of the chassis; or wherein the first height sensor arrangement comprising a plurality of height sensors coupled to the first side of the tool or to the first side of the chassis using a support mechanism.

9. The road construction machine according to claim 1, wherein the first height sensor arrangement is attached to the tool or to the chassis, or wherein the first height sensor arrangement is attached to a tow arm towing the tool.

10. The road construction machine according to claim 1, wherein the first height sensor arrangement is arranged in front of and/or behind the tool when seen within a driving direction of the road construction machine.

11. The road construction machine according to claim 1, wherein the second height sensor arrangement comprising a plurality of height sensors coupled to the second side of the tool or to the second side of the chassis; or wherein the second height sensor arrangement comprising a plurality of height sensors coupled to the second side of the tool or to the second side of the chassis using a support mechanism.

12. The road construction machine according to claim 1, wherein the second height sensor arrangement is attached to the tool or to the chassis, or wherein the second height sensor arrangement is attached to a tow arm towing the tool.

13. The road construction machine according to claim 1, wherein the second height sensor arrangement is arranged in front of and/or behind the tool when seen within a driving direction of the road construction machine.

14. The road construction machine according to claim 1, wherein the tool extends in parallel to the underground or the applied layer and/or substantially perpendicular to a driving direction of the road construction machine; and/or wherein the tool comprises a screed or a milling unit.

15. A method for performing a levelling for road construction machines, especially for a paving machine or a milling machine, the road construction machine comprises a chassis and a tool, the method comprising:

determining a first distance information as first actual value for a distance to an underground or to an applied layer in reference to a reference point belonging to the first side of the tool or to a first side of the chassis using a first height sensor arrangement coupled to a first side of the tool or to the first side of the chassis;

determining a second information serving as second actual value for a distance to the underground or to the applied layer in reference to the reference point belonging to the second side of the tool or to a second side of the chassis using a second height sensor arrangement coupled to the tool or to the second side of the chassis;

controlling, using a first independent controller loop, a height position of the first side of the tool or of the first side of the chassis based on the first actual value and a first set point for the height position of the first side of the tool or of the first side of the chassis and controlling, using a second independent controller loop independent from the first independent controller loop, a height position of the second side of the tool or of the second side of the chassis based on the second actual value and a second set point for the height position of the second side of the tool or of the second side of the chassis;

determining an actual reference value using an additional sensor coupled to the tool or to the chassis, the actual reference value describing a height position of either the first or the second side of the tool or either the first or the second side of the chassis of the chassis; and adapting either the first or the second setpoint set point based on said actual reference value.

16. A non-transitory digital storage medium having a computer program stored thereon to perform the method for performing a levelling for road construction machines, especially for a paving machine or a milling machine, the road construction machine comprises a chassis and a tool, the method comprising:

determining a first distance information as first actual value for a distance to an underground or to an applied layer in reference to a reference point belonging to the first side of the tool or to a first side of the chassis using a first height sensor arrangement coupled to a first side of the tool or to the first side of the chassis;

determining a second information serving as second actual value for a distance to the underground or to the applied layer in reference to the reference point belonging to the second side of the tool or to a second side of the chassis using a second height sensor arrangement coupled to the tool or to the second side of the chassis;

controlling, using a first independent controller loop, a height position of the first side of the tool or of the first side of the chassis based on the first actual value and a first set point for the height position of the first side of the tool or of the first side of the chassis and controlling, using a second independent controller loop independent from the first independent controller loop, a height position of the second side of the tool or of the second side of the chassis based on the second actual value and a second set point for the height position of the second side of the tool or of the second side of the chassis;

determining an actual reference value using an additional sensor coupled to the tool or to the chassis, the actual reference value describing a height position of either the first or the second side of the tool or of either the first or the second side of the chassis; and adapting either the first or the second set point based on said actual reference value, when said computer program is run by a computer.

17. A road construction machine, especially a paving machine or a milling machine, comprising a levelling system, the road construction machine comprising a chassis and a tool, the levelling system comprising:

a first height sensor arrangement coupled to a first side of the tool or to a first side of the chassis of the machine and configured to determine a first distance information as first actual value for a distance to an underground or to an applied layer in reference to a reference point belonging to the first side of the tool or to the first side of the chassis; and a second height sensor arrangement coupled to the second side of the tool or to a second side of the chassis and configured to determine a second distance information serving as second actual value for a distance to the underground or to the applied layer in reference to the reference point belonging to the second side of the tool or to the second side of the chassis; and a first controller comprising a first independent controller loop configured to control a height position of the first side of the tool or of the machine chassis based on the first actual value for said distance to the underground or to the applied layer and a first set point for the height position of the first side of the tool or of the chassis; and a second controller comprising a second independent controller loop independent from the first independent controller loop and configured to control a height position of the second side of the tool or of the chassis based on the second actual value for said distance to the underground or to the applied layer and a second set point for the height position of the second side of the tool or of the chassis; and an additional sensor coupled to the tool or the chassis and configured to determine an actual reference value for either the first or the second side of the tool or either the first or the second side of the chassis, the actual reference value describing a height position of either the first or the second side of the tool or either the first or the second side of the chassis;

wherein the first controller is configured to adapt the respective first set point based on the actual reference value of the additional sensor for a set point adaption and the second controller is configured to adapt the respective set point based on the actual reference value of the additional sensor for the set point adaption, wherein the set point adaption performed by the first or the second controller takes place only either on the first side or the second side of the tool or of the chassis;

wherein the first height sensor arrangement comprising a plurality of height sensors coupled to the first side of the tool or to the first side of the chassis; or wherein the first height sensor arrangement comprising a plurality of height sensors coupled to the first side of the tool or to the first side of the chassis using a support mechanism.

* * * * *